United States Patent [19]

Marker

[11] Patent Number: 4,807,550

[45] Date of Patent: Feb. 28, 1989

[54] BELAYING CLAMP

[76] Inventor: Hannes Marker, Alpspitzstrasse 37, D-8100 Garmisch-Partenkirchen, Fed. Rep. of Germany

[21] Appl. No.: 96,013

[22] PCT Filed: Dec. 13, 1986

[86] PCT No.: PCT/EP86/00746

§ 371 Date: Oct. 16, 1987

§ 102(e) Date: Oct. 16, 1987

[87] PCT Pub. No.: WO87/03854

PCT Pub. Date: Jul. 2, 1987

[30] Foreign Application Priority Data

Dec. 20, 1985 [DE] Fed. Rep. of Germany ..... 3545340

[51] Int. Cl.[4] ..... B63H 9/04

[52] U.S. Cl. ..... 114/109; 114/219; 254/209

[58] Field of Search ..... 114/39.1, 39.2, 102, 114/109, 218; 254/209

[56] References Cited

FOREIGN PATENT DOCUMENTS

| | | | |
|---|---|---|---|
| 3324900 | 10/1984 | Fed. Rep. of Germany | 114/109 |
| 3520137 | 12/1986 | Fed. Rep. of Germany | 114/39.2 |
| 426957 | 4/1935 | United Kingdom | 114/109 |

*Primary Examiner*—Sherman D. Basinger
*Assistant Examiner*—Jesus D. Sotelo
*Attorney, Agent, or Firm*—Fleit, Jacobson, Cohn & Price

[57] ABSTRACT

This invention relates to a belaying clamp for releasably fixing a stretching rope to the boom or mast base of a windsurfing craft. To permit the sail to be retrimmed with a relatively small effort and while the craft is on the water, the belaying clamp (10) is directly connected to the boom (1) or mast base by means of an adjusting element (5).

8 Claims, 2 Drawing Sheets

BELAYING CLAMP

DESCRIPTION

Figure 1:
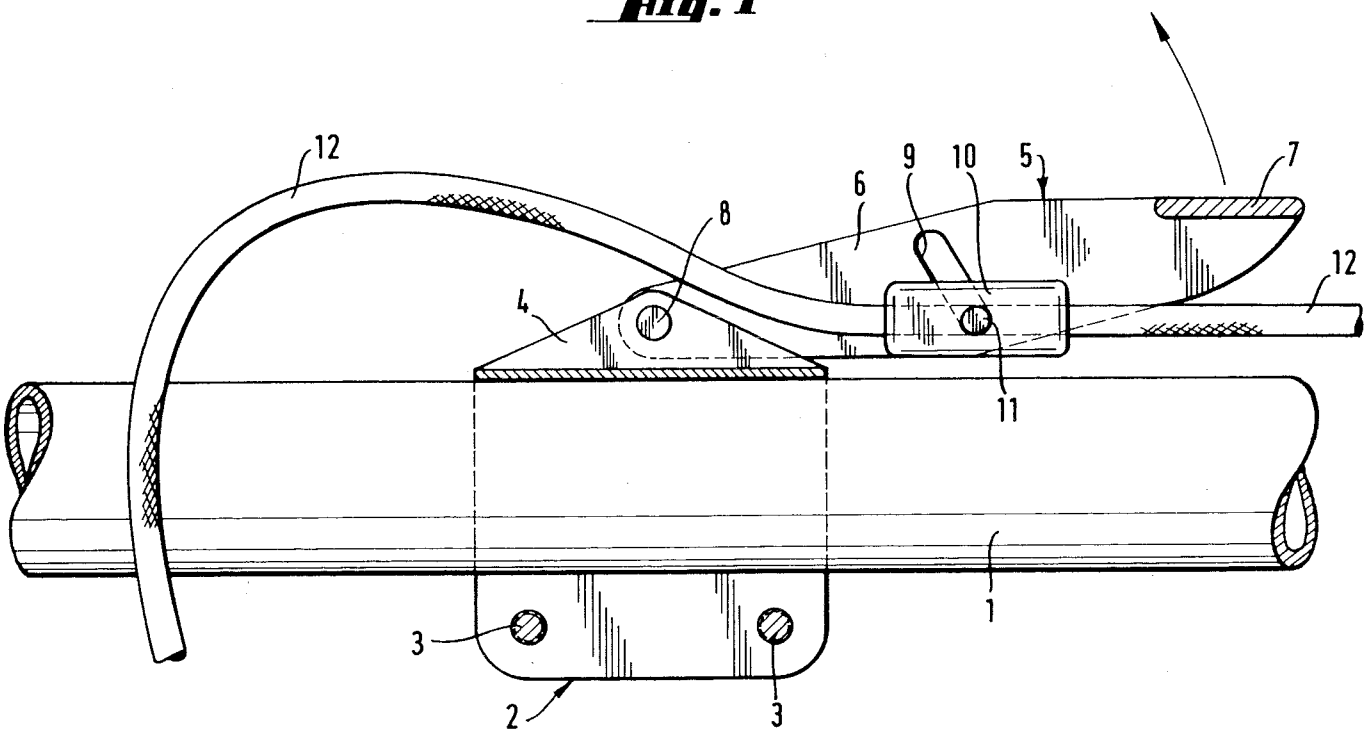

This invention relates to belaying clamps for releasably fixing an end of a stretching rope to the boom or mast base of a windsurfing craft.

Such belaying clamps have previously been fixed to the boom or mast base of the windsurfing craft. But it has been found in practice that particularly a retrimming of the sail when the craft is on the water cannot satisfactorily be performed and requires a considerable effort so that surfing is often practiced with a sail which is not properly trimmed for the current wind.

Various proposals to eliminate said disadvantage have been made and part of them have been reduced to practice. For instance, a luff stretcher has been provided, which incorporates a pulley block. Another proposal calls for the use of a reel for winding up the stretching rope.

Finally, a luff stretcher is known which comprises a tensioning lever. That luff stretcher is used in combination with a variable mast base and for the insertion into the mast base comprises a tightener base, which carries the tensioning lever. The latter has a hole for receiving the stretching sheet for stretching the luff and is held in tensioning position by a locking hook. That design is intended to replace the conventional belaying clamps.

In accordance with the present invention the advantageous belaying clamp is not to be omitted. For this reason it is an object of the invention to provide the belaying clamp in an arrangement which will optimally meet all requirements encountered in practice regarding a correct and simple trimming and retrimming of the sail.

This is accomplished in accordance with the invention in that the belaying clamp is indirectly connected to the boom or mast base by means of an adjusting element. Owing to the adjusting element the trimming of the sail can be changed and adapted to the current requirements quickly and in a simple manner and without a great effort, even when the craft is on the water.

The invention may be embodied in that the adjusting element consists of a wedge drive.

In an advantageous and particularly simple structure the adjusting element consists of a one-armed lever having a pivot which is transverse to the boom or mast base.

It has been found that for an individual and optimum operation of the adjusting element the latter may be secured to the boom or the mast base by means of a pipe clip.

In a design comprising an adjusting element consisting of a lever it has been found that it is desirable to pivot the belaying clamp to the lever on an axis which is transverse to the longitudinal direction of the clamp and parallel to the pivot for the lever.

In that case the lever is movable to two operating positions and in each of said positions is at least approximately parallel to the boom or mast base. It has been found that when the lever has been moved to extend in the direction in which the stretching rope is to be tensioned the pivotal axis of the belaying clamp is desirably closer to the boom or mast base than the pivot for the lever. The resulting overcenter position of the lever will eliminate the need for a separate member for locking the lever.

A simple and lightweight lever will be obtained if the lever comprises two cheeks, which are disposed on opposite sides of the belaying clamp and at their free ends are interconnected by a web.

The free ends of the pivot for the belaying clamp are desirably mounted on the lever in slots, which preferably extend obliquely and particularly at 45° to the longitudinal direction of the lever. As a result, the lever is additionally held in its current position when the clamp is belayed.

Also within the scope of the invention the extent of the tensioning movement imparted to the belaying clamp by the turning of the lever can be varied because at least a second bearing for the belaying clamp is provided on the lever. The bearings are suitably interconnected by a weblike recess.

An illustrative embodiment of the invention will be described in detail hereinafter with reference to the accompanying drawings, in which FIG. 1 shows the arrangement of a belaying clamp on a lever, which is shown in a position in which it does not tension the rope.

Figure 2:
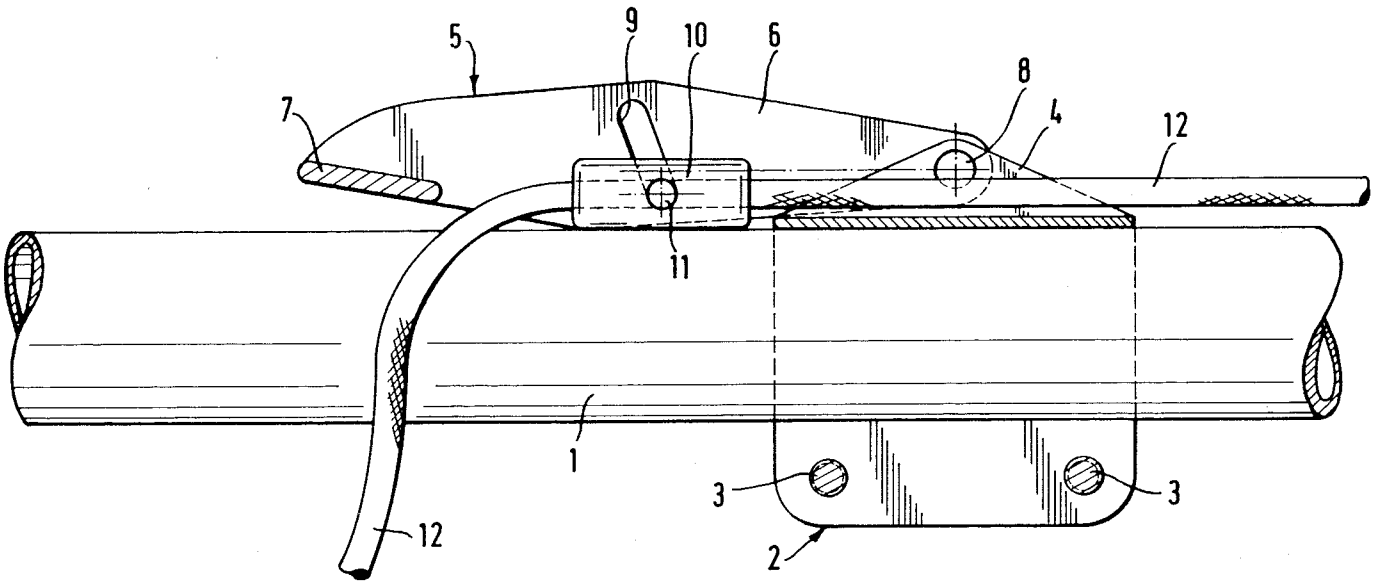

FIG. 2 shows the arrangement of FIG. 1 with the lever turned to its tensioning position.

The arrangement of the belaying clamp is shown in a central sectional view as it is mounted on a boom of a windsurfing craft or on a spar 1 of a boom. A pipe clip 2 is detachably secured to the spar by means of screws 3 so that a surfer can select for the pipe clip that position on the spar which is proper for that surfer. The pipe clip comprises two lugs (4), which in the drawings extend upwardly and are so spaced apart that a stretching rope (12) can extend between said lugs. A lever (5) is pivoted to the lugs (4) by means of respective pivot pins 8, which are coaxial to each other. In the present case the lever comprises two congruent cheeks (6), which are interconnected by a web (7), which serves also as a handle for turning the lever.

Each side cheek (6) of the lever (5) is formed with a slot (9), which is oblique to the longitudinal direction of the lever. A belaying clamp (10) comprises two coaxial pivot pins (11), which extend into respective slots (9) so that the belaying clamp is pivotally movable relative to the lever.

In the position shown in FIG. 1 the stretching rope is held in the belaying clamp (10) and the lever (5) is in the position in which it does not tension the rope. But because a certain initial tension has been imparted to the stretching rope as the clamp was belayed during the trimming of the sail, the clamp is in the position shown, in which the pivot pins (11) are at the lower ends of the slots (9).

To tension the clamp (12) for a trimming or retrimming of the sail, which is not shown, the lever (5) is moved from the position shown in FIG. 1 about the pivot pins (8) to the position shown in FIG. 2 so that the tensioning displacement is virtually twice the distance from the pivot pins (11) to the pivot pins (8). It is apparent from FIG. 2 that in this tensioning position the pivot pins (11) are closer to the spar (1) than the pivot pins (8) of the lever (5) so that an overcenter position has been obtained, which will prevent an unintended turning back of the lever. The pivot pins (11) are now disposed at the other end of the slots (9) and that end is now the lower end. Because the belaying clamp is held in that position by the tension of the rope (12), it will hold the lever in position owing to the oblique slots.

I claim:

1. A belaying clamp for releasably fixing an end of a stretching rope to the boom or mast base of a windsurfing craft, comprising a clamp and adjusting means for indirectly connecting the clamp to the boom or mast base of a boat wherein the adjusting means includes a lever having a pivot which on mounting extends transversely to the boom or the mast base of the boat and wherein the clamp is pivoted to the lever about an axis which is transverse to the longitudinal direction of the clamp and parallel to the pivot for the lever.

2. A belaying clamp according to claim 1 wherein the adjusting means is intended to be held on the boom or mast base by means of a pipe clip.

3. A belaying clamp according to claim 1 wherein two operating positions are provided for the lever and the lever is at least approximately parallel to the boom or the mast base in each of said positions.

4. A belaying clamp according to claim 3, wherein when the lever has been turned to extend in the direction in which a stretching rope is adapted to be tensioned, the pivotal axis of the clamp is closer to the boom or the mast base than the pivot for the lever.

5. A belaying clamp according to claim 1 wherein the lever has two cheeks, which are disposed on opposite sides of the clamp and are interconnected at their free ends by a web.

6. A belaying clamp according to claim 1 wherein the free ends of the pivot for the clamp are movably mounted in the lever in slots.

7. A belaying clamp according to claim 6, wherein the slots extend obliquely to the longitudinal direction of the lever, preferably at 45°.

8. A belaying clamp according to claim 1 wherein the lever is provided with a bearing for the clamp.

* * * * *